US012209459B2

(12) United States Patent
Herman et al.

(10) Patent No.: US 12,209,459 B2
(45) Date of Patent: Jan. 28, 2025

(54) WELLBORE REAMING TOOL HAVING FIXED MOUNTED GOUGING CUTTERS

(71) Applicant: Shear Bits, Inc., Spring, TX (US)

(72) Inventors: John James Herman, Cypress County (CA); Carl M. Hoffmaster, Houston, TX (US)

(73) Assignee: Shear Bits, Inc., Spring, TX (US)

( * ) Notice: Subject to any disclaimer, the term of this patent is extended or adjusted under 35 U.S.C. 154(b) by 0 days.

(21) Appl. No.: 18/154,341

(22) Filed: Jan. 13, 2023

(65) Prior Publication Data

US 2023/0228156 A1 Jul. 20, 2023

Related U.S. Application Data

(63) Continuation of application No. PCT/US2021/041432, filed on Jul. 13, 2021.

(60) Provisional application No. 63/051,914, filed on Jul. 15, 2020.

(51) Int. Cl.
*E21B 10/26* (2006.01)

(52) U.S. Cl.
CPC ..... *E21B 10/26* (2013.01)

(58) Field of Classification Search
CPC ..... E21B 10/26
See application file for complete search history.

(56) References Cited

U.S. PATENT DOCUMENTS

| | | | | |
|---|---|---|---|---|
| 6,386,302 | B1 * | 5/2002 | Beaton | E21B 10/265 175/391 |
| 8,607,900 | B1 | 12/2013 | Smith | |
| 8,776,912 | B2 | 7/2014 | Makkar et al. | |
| 2002/0020565 | A1 * | 2/2002 | Hart | E21B 10/26 175/398 |
| 2011/0005841 | A1 * | 1/2011 | Wood | E21B 10/26 175/385 |
| 2014/0008128 | A1 * | 1/2014 | Adam | E21B 10/32 175/57 |
| 2014/0048335 | A1 | 2/2014 | Mensa-Wilmot | |
| 2017/0058610 | A1 | 3/2017 | Lin, Jr. et al. | |
| 2018/0258703 | A1 | 9/2018 | Reilly | |
| 2019/0040687 | A1 | 2/2019 | Herman et al. | |

OTHER PUBLICATIONS

International Search Report and Written Opinion, International Application No. PCT/US2021/041432 dated Dec. 8, 2021.

(Continued)

*Primary Examiner* — Taras P Bemko
*Assistant Examiner* — Ronald R Runyan
(74) *Attorney, Agent, or Firm* — Richard A. Fagin

(57) ABSTRACT

A reaming tool includes a reaming tool body configured to be coupled within a drill string or a string of drilling tools. A plurality of reaming blocks is attached to the reaming tool body at circumferentially spaced apart locations. At least one reaming block comprises at least a first row of gouging cutters and a second row of gouging cutters. The gouging cutters in the first row define a first profile. The gouging cutters in the second row define a second profile. The first row is rotationally ahead of the second row. The first profile at any longitudinal position along the at least one reaming block defines a larger reaming diameter than the second profile.

18 Claims, 4 Drawing Sheets

(56) References Cited

OTHER PUBLICATIONS

Tim Beaton: "A Hybrid Solution", Nov. 1, 2014 (Nov. 1, 2014), pp. 1-5, XP093157823, Retrieved from the Internet: URL:http://www.shearbits.com/downloads/Pex us%20(large%20diameter)%20-%20Oilfield%20T echnology%20-%20Nov%202014.pdf [retrieved on Apr. 30, 2024].
Extended European Search Report dated May 17, 2024, for European Application No. 21841696.4.
Office Action dated May 9, 2024, for Canadian Patent Application No. 3, 189,357.

* cited by examiner

WELLBORE REAMING TOOL HAVING FIXED MOUNTED GOUGING CUTTERS

CROSS REFERENCE TO RELATED APPLICATIONS

Continuation of International Application No. PCT/US2021/041432 filed on Jul. 13, 2021. Priority is claimed from U.S. Provisional Application No. 63/051,914 filed on Jul. 15, 2020. Each of the foregoing applications is incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of wellbore reaming tools used to enlarge the diameter of a wellbore that has been drilled by a drill bit. More specifically, the disclosure relates to reaming tools having gouging cutters.

U.S. Patent Application Publication No. 2004/0159468 discloses a reaming tool that may be used in a drill string, when disposed behind a drill bit located at one end of the drill string. The reaming tool disclosed in the '468 publication may provide the ability to enlarge a wellbore drilled by the drill bit to a larger diameter than that drilled by the drill bit during drilling. Such feature provides that a subsequent "trip" into the well (fully removing and reinserting the drill string) with a separate reaming tool may not be required. The reaming tool disclosed in the '468 publication may have reaming blocks (devices to mount cutting elements or "cutters") fixedly attached to a reaming tool body, or may have reaming blocks that may be expanded to a selected diameter during operation using any one of a number of well-known diametrically expandable mechanisms, such as hydraulic cylinders and associated hydraulic rams.

The reaming tool described in the '468 publication may comprise a plurality of shearing-type cutting elements ("shear cutters"), for example and without limitation polycrystalline diamond compact (PDC) cutters. Shear cutters such as PDC cutters may be made, for example, by affixing a polycrystalline diamond "table" on a substrate. The substrate may be formed for example, from material such as tungsten carbide, or steel having a wear resistant outer layer, such outer layer being made from material such as tungsten carbide.

In some subsurface earthen formations, reaming a wellbore using a reaming tool having shear cutters has proven disadvantageous. Such subsurface formations have shown a tendency to cause breakage of the shear cutters. Gouging type cutters are used in drill bits for drilling mine shafts or tunnels, among other uses. Such drill bits are known in the art as "claw" bits, one example of which is sold under the trademark QUI-KLAW, which is a trademark of Drillhead, Inc. Such drill bits are known to be useful in drilling subsurface formations such as clay, unconsolidated sand, loose rock and gravel.

U.S. Pat. No. 8,505,634 issued to Lyons et al. describes a drill bit having gouging cutting elements disposed adjacent to shearing cutting elements on a blade on the bit body. The shearing cutting elements have a planar cutting face, while the gouging cutting elements have a non-planar cutting face, e.g., dome shaped or cone shaped, also referred to as "ballistically shaped."

U.S. Pat. No. 10,570,664 issued to Herman et al. discloses a wellbore reaming tool having shear cutters and gouging cutters arranged particularly on one or more tapered reaming blocks around the circumference of the reaming tool. The disclosed reaming tool has proven effective; there are however, certain rock formations in which tool longevity and performance need to be improved over the reaming tool disclosed in the '664 patent.

SUMMARY

A reaming tool according to one aspect of this disclosure includes a reaming tool body configured to be coupled within a drill string or a string of drilling tools. A plurality of reaming blocks is attached to the reaming tool body at circumferentially spaced apart locations. At least one reaming block comprises at least a first row of gouging cutters and a second row of gouging cutters. The gouging cutters in the first row define a first profile. The gouging cutters in the second row define a second profile. The first row is rotationally ahead of the second row. The first profile at any longitudinal position along the at least one reaming block defines a larger reaming diameter than the second profile.

In some embodiments, the first profile extends more than the second profile by a variable offset.

In some embodiments, the variable offset decreases monotonically to zero at the gage diameter.

In some embodiments, the cutters in the second row are longitudinally displaced from the cutters in the first row so as to increase reaming coverage between a gage diameter of the reaming tool and a gage diameter of a drill bit disposed in a drill string ahead of the reaming tool.

In some embodiments, the second row is disposed on an opposed side of a junk slot in the at least one reaming block than the first row.

In some embodiments, the second row is disposed on a same side of a junk slot in the at least one reaming block than the first row.

Some embodiments further comprise a further first row of gouging cutters and a further second row of gouging cutters on an opposite side of the junk slot as the first row and the second row.

In some embodiments, the reaming blocks each defines a tapered profile in a longitudinal direction along the reaming tool.

In some embodiments, each of the plurality of reaming blocks comprises at least a first row of gouging cutters, and a second row of gouging cutters, the gouging cutters in the first row defining a first profile, the gouging cutters in the second row defining a second profile, wherein the first row is rotationally ahead of the second row, and wherein the first profile at any longitudinal position along the at least one reaming block defines a larger reaming diameter than the second profile.

Other aspects and advantages will be apparent from the description and claims that follow.

DETAILED DESCRIPTION

Figure 1:
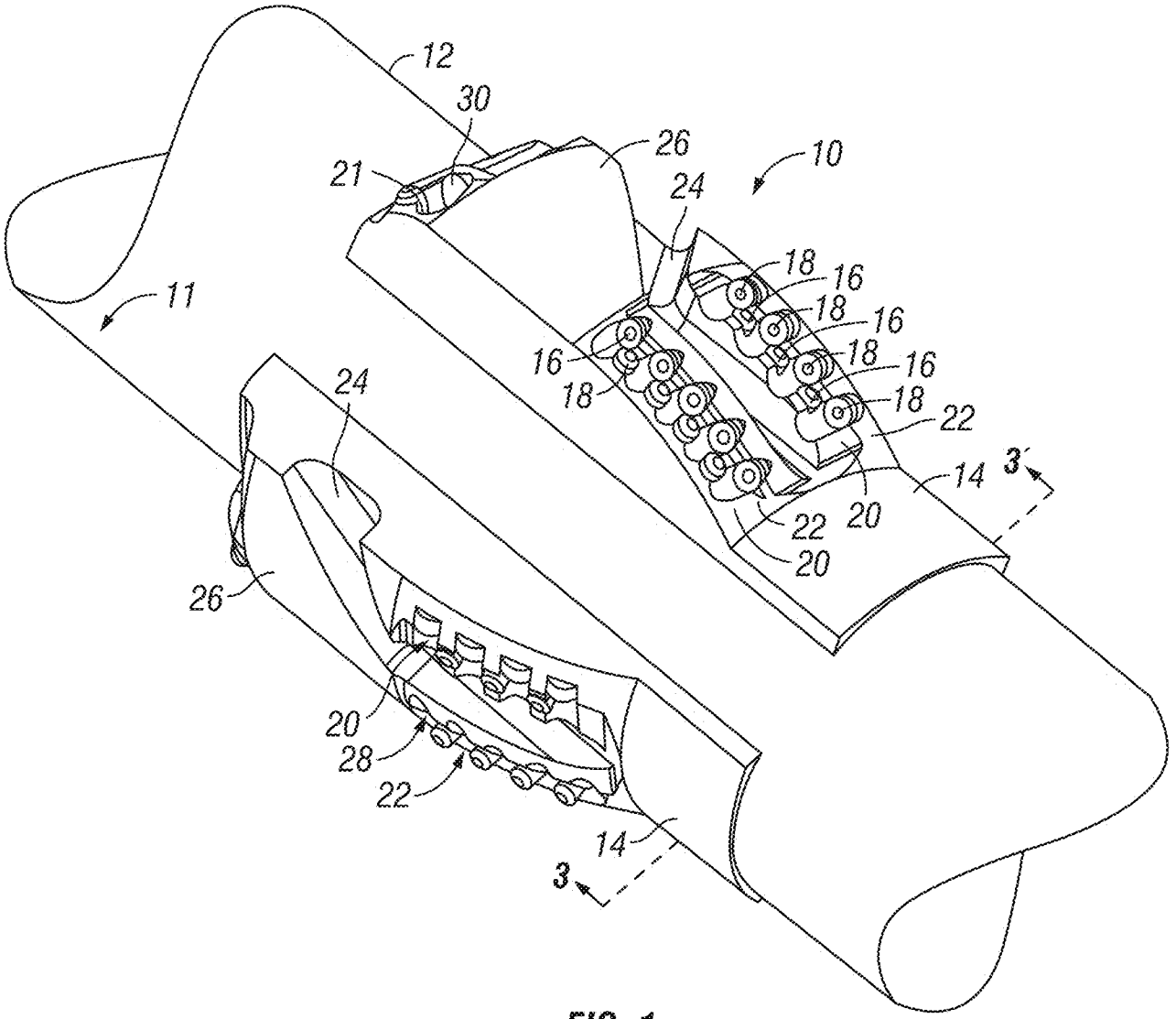
FIG. 1 shows an oblique view of an example embodiment of a reaming tool according to the present disclosure.

FIG. 1 shows an oblique view of an example embodiment of a reaming tool 10 according to the present disclosure. The reaming tool 10 may comprise a reaming tool body 12. The reaming tool body 12 may be made from any material known in the art to be used for connection within a drill string or assembly of drilling tools, including for example and without limitation, steel, monel, and an alloy sold under the trademark INCONEL, which is a registered trademark of Huntington Alloys Corporation, Huntington, W. Va. The reaming tool body 12 may comprise threaded connections (not shown) at its longitudinal ends to enable connection within a drill string or drilling tool assembly (not shown). The reaming tool body 12 may be assembled to such a drill string or drilling tool assembly (not shown) at a selected longitudinal position apart from (above when disposed in a well) a drill bit (not shown) to enable simultaneous drilling and reaming of a subsurface wellbore by rotating the drill string or drilling tool assembly and axially urging the drill string or drilling tool assembly to lengthen the wellbore and contemporaneously enlarge its diameter beyond that of the diameter drilled by the drill bit (not shown). In the present example embodiment, the direction of rotation of the reaming tool body 12 during such use is indicated by an arrow at 11.

The reaming tool body 12 may comprise a plurality of reaming blocks 14 disposed about the circumference of the reaming tool body 12. In the present example embodiment, there may be three such reaming blocks 14 (see FIG. 3), disposed at 120 degrees angular circumferential separation from each other. In other embodiments, more of fewer reaming blocks 14 may be provided while remaining within the scope of this disclosure. It is contemplated that a minimum of two reaming blocks 14 separated circumferentially by 180 degrees may be used in some embodiments. In other embodiments, the circumferential separation between reaming blocks 14 may be 360 degrees divided by the number or reaming blocks. In some embodiments, a circumferential surface dimension (distance about the circumference transverse to the longitudinal axis of the reaming tool body 12) of each of the reaming blocks 14 may be inversely related to the number of reaming blocks.

The reaming blocks 14 may be made from, for example and without limitation, steel, monel or the INCONEL alloy set forth above. The reaming blocks 14 may have a wear resistant exterior layer such as may be made from metallic carbide, e.g., tungsten carbide or other wear resistant material. In the present example embodiment, gouging cutters 18 arranged in first rows 20, and gouging cutters 16 arranged in second rows 22 may be affixed to at least one or each of the reaming blocks 14. Each such first row 20 and second row 22 may be arranged to extend generally along the longitudinal dimension of the reaming tool body 12; in some embodiments, one or each such first row 20, and second row 22 of cutters may include some rotational (circumferential) offset or displacement with respect to position along the longitudinal dimension of the reaming tool body 12, e.g., so as to traverse a helical pattern. In the present example embodiment, the second row 22 of gouging cutters 16 on any one or more reaming blocks may be disposed rotationally behind the first row 20 of gouging cutters 18, "behind" meaning with reference to the direction of rotation 11 of the reaming tool body 12 during operation of the reaming tool 10 in a well.

In some embodiments, the first row 20 and the second 22 row of cutters 18, 16 may be separated by a junk slot 24 or similar structure formed in the face of the reaming block 14 to provide a path to enable reaming tool cuttings to be readily moved away from the reaming block 14 during reaming operations. The reaming tool cuttings may be moved by the flow of drilling fluid or other wellbore fluid circulated through the drill string during drilling and/or reaming operations and consequently lifted out of the well (not shown) to the surface.

As stated above, in the present example embodiment, the first row 20 of gouging cutters 18 may be located rotationally ahead of the second row 22 on any one or more reaming blocks 14. Thus, the gouging cutters 18 in the first row 20 contact and thus cut (ream) the formation before the gouging cutters 16 in the second row 22. The gouging cutters 18 in the first row 20 may each be disposed directly rotationally in front of a corresponding gouging cutter 16 in the second row 22, or, as shown in FIG. 1, may be longitudinally alternated with the cutters 16 in the second row 22. Longitudinally alternating means that at any longitudinal position, substantially only one first row cutter or one second row cutter is present, it being within the scope of such definition that some longitudinal overlap may exist between first row cutter and second row cutters depending on the longitudinal spacing between adjacent cutters in any individual row and the diameter of the cutters.

The reaming blocks 14 may define a cutting profile surface 28 such that the diameter subtended by the gouging cutters 18, 16 increases with respect to longitudinal position along the direction of reaming of the reaming tool 10, that is, the subtended diameter increases with increasing distance away from the drill bit (not shown) coupled ahead of the reaming tool 10.

Figure 2:
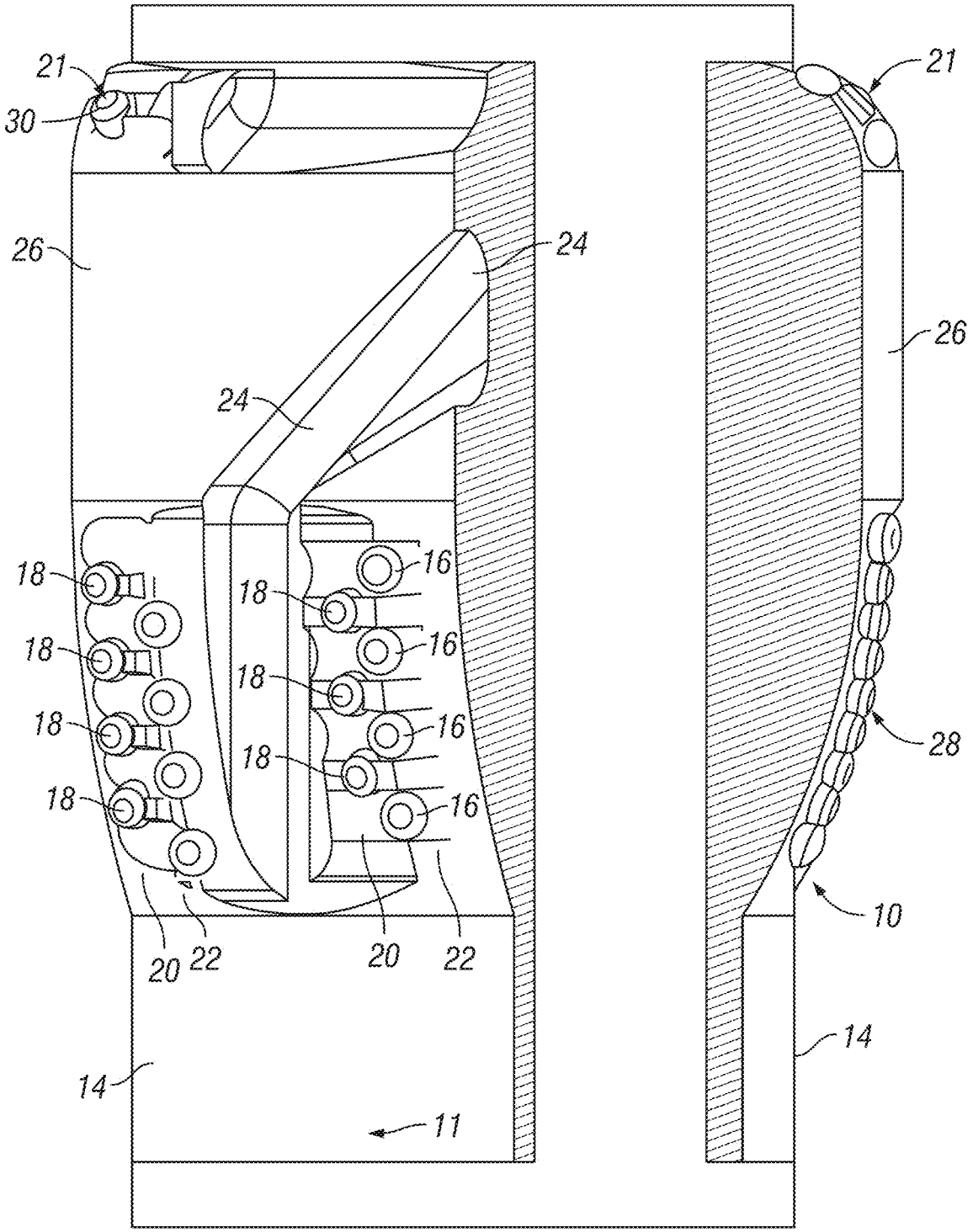
FIG. 2 shows a side view of the example embodiment of a reaming tool as shown in FIG. 1.

The profile surface 28 may be better observed in FIG. 2. Any profile surface known to be used for fixed cutter reaming blocks may be used in various embodiments; some such embodiments will be further explained below with reference to FIGS. 3 and 4. The reaming blocks 14 may each define a gage surface 26 proximate a longitudinal upper end (farthest away from the drill bit) of the reaming block 14. The gage surface 26 may serve to stabilize motion of the reaming tool 10 in a wellbore to produce a relatively smooth wellbore interior surface as a result of reaming. At an upper end of one or more of the reaming blocks 14, a backreaming cutter assembly 21 may be provided above the upper longitudinal end of the gage surface 26. The backreaming cutter assembly 21 may comprise at least gouging cutters 30 arranged rotationally and longitudinally as in the rows 20, 22 of gouging cutters in the profile 28 part of the reaming block 14.

The gouging cutters 18, 16 may be configured to be mounted directly to the reaming block 14 in corresponding pockets (not shown separately) such as by brazing. The gouging cutters in some embodiments may be mounted to the reaming block 14 so as to be rotatable within the respective mounting pocket, e.g., using snap rings or similar retaining devices. The gouging cutters 18, 16 in some embodiments may be mounted so that the respective longitudinal axis (CL in FIG. 4) of each of the gouging cutters is within 30 degrees of perpendicular to the face (F in FIG. 3)

of the respective reaming block 14. In the embodiment shown in FIG. 1, the mounting and arrangement of the gouging cutters 18, 16 may enable increased cutting coverage, that is, having cutters disposed at more diameter positions between the gage diameter of the drill bit (not shown) and the gage diameter, defined by the gage surface 26, of the reaming tool 10 than would be possible using other mounting and arrangement of gouging cutters 18, 16 on any or each reaming block 14. The gouging cutters 18, 16 are mounted to the reaming blocks 14 so that the respective position with reference to the reaming tool body 12 is fixed, that is, the gouging cutter longitudinal position does not change during reaming operation. Such mounting is thus distinguishable from mounting of cutters on a roller reaming tool, wherein cutters mounted on one or more rollers move position with reference to the tool body during operation. The foregoing explanation, made in terms of reaming operation of a roller reaming tool, is intended to exclude reaming tools which have reaming blocks movably mounted to the reaming tool body, in which the cutters may move laterally with the reaming blocks but not longitudinally other than incidental longitudinal motion in some types of radial expansion mechanisms.

The gouging cutters 18 may be substantially ballistically shaped, i.e., conically shaped or dome (hemispherically) shaped. In any event, the shape of the gouging cutters 18, 16 may be such that the cutting surface is non-planar, as contrasted with shear cutters known in the art which have essentially planar cutting surfaces. The gouging cutters 18, 16 may be made from steel covered with a wear resistant material such as metal carbide. Such carbide may be, e.g., tungsten carbide, or the gouging cutters 18, 16 may be made entirely from metal carbide, e.g., tungsten carbide. In some embodiments, some or all of the gouging cutters 18, 16 may be made from or may be covered by a layer of "ultra hard" material such as polycrystalline diamond (PCD) or cubic boron nitride (CBN). In some embodiments, some or all of the gouging cutters 18, 16 may be made in the form of a diamond monolith. In some embodiments, some or all of the gouging cutters 18, 16 may comprise impregnated diamond in the body of the gouging cutter(s) 18, 16, which may be made from a different material such as tungsten carbide.

FIG. 2 shows a side view of an example embodiment of the reaming tool 10, wherein a view of some of the possible features of the reaming blocks 14 are more clearly observable. A possible cutting profile 28 may be readily observed in the side view of the reaming block 14 in the upper part of FIG. 2, as well as a profile subtended by a backreaming cutter assembly 21 located above the top of the gage surface 26. "Above" in the present context means in a direction toward the surface end of a subterranean well in which the reaming tool 10 may be deployed. One example of a shape of the junk slot 24 may be observed in the lower reaming block 14 shown in FIG. 2. The relative rotational and longitudinal positions of the gouging cutters 18 in the first row 20 and the gouging cutters 16 in the second row 22 that may be present in some embodiments may be better observed in the lower part of FIG. 2. In the embodiment shown in FIG. 2, the first row 20 and the second row 22 may both be on the same side of the junk slot 24. In embodiments such as in FIG. 2, a further first row 20 and second row 22 may be located on the opposite side of the junk slot 24. The longitudinal positions of the gouging cutters 18 in the first row 20 may be longitudinally staggered with respect to the longitudinal positions of the gouging cutters 16 in the second row 22. Such longitudinal arrangement of the gouging cutters 18, 16 may enable more diameter coverage of the reaming tool 10.

For purposes of defining the scope of the present disclosure, it is only necessary that at least one reaming block 14 to have more than one row of cutters, wherein a "row" is defined as longitudinally substantially contiguously arranged gouging cutters along the longitudinal dimension of the reaming block 14, for the first row 20 of gouging cutters 18 to be disposed rotationally ahead of the second row 22 of gouging cutters 16 on the same reaming block 14. Rotationally ahead may be defined as forward along the direction of rotation 11.

Figure 3:
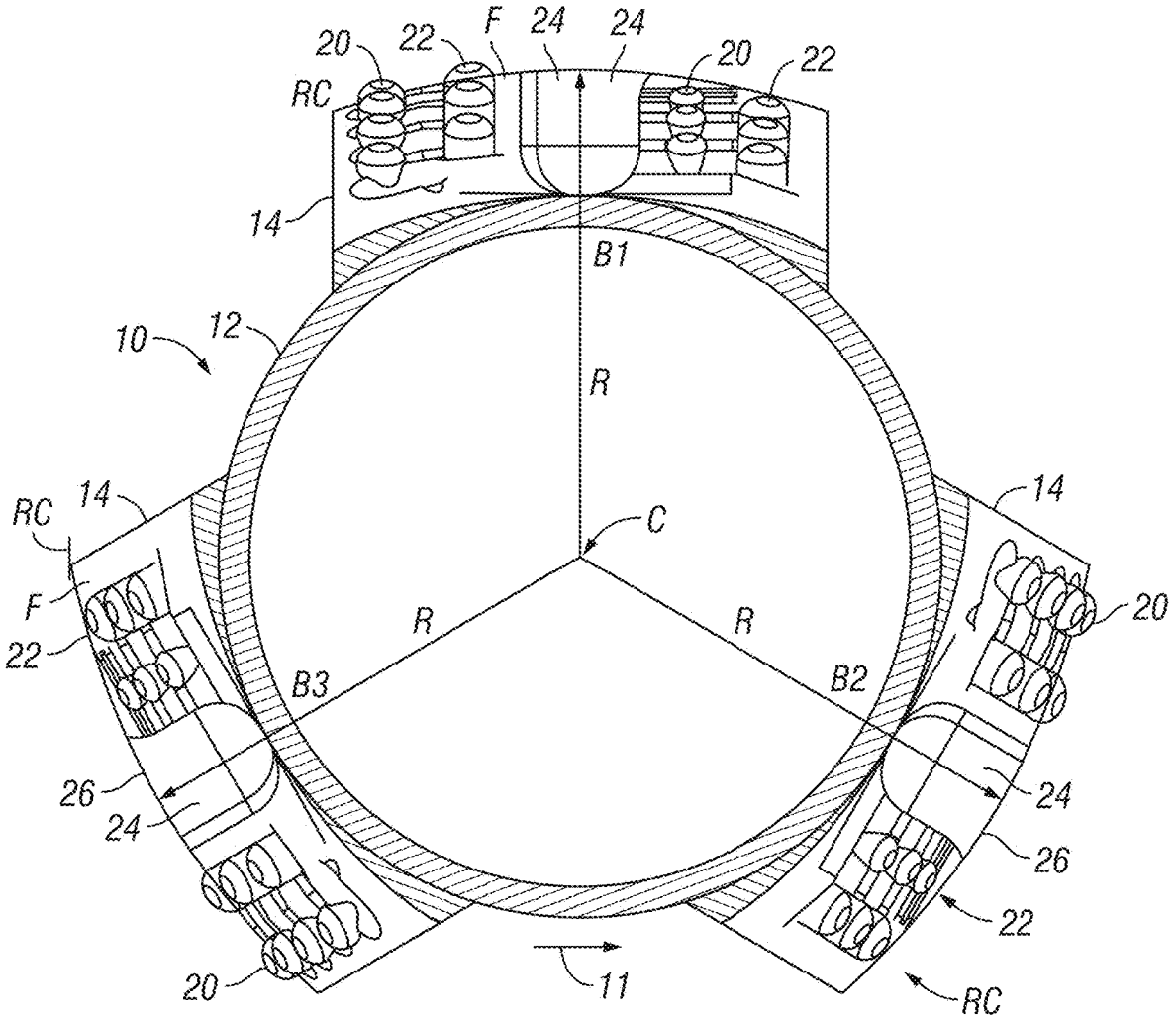
FIG. 3 shows a cross-sectional view of the example embodiment of a reaming tool shown in FIG. 1.

FIG. 3 shows a cross section of the reaming tool 10 along line 3-3' in FIG. 1. The gage surface 26 of each reaming block 14 is arranged to be disposed at a selected radius R from the center or rotation C of the reaming tool body 12. A radius of curvature RC of each gage surface 26 may be selected to match the selected radius R defined by each gage surface 26. The present example embodiment comprises three reaming blocks 14. As explained above with reference to FIG. 1, more or fewer reaming blocks 14 may be used in other embodiments to equal effect. The direction of rotation is indicated in FIG. 2 at 11. The surface F of the reaming blocks may be observed in order to better understand mounting of the gouging cutters 18, 16.

FIG. 3 also shows various possible embodiments of arrangements of gouging cutters 18, 16 on each reaming block 14. The uppermost reaming block 14 in FIG. 3 may comprise four rows of gouging cutters, arranged in two, first rows 20 wherein each such first row 20 is rotationally ahead of a corresponding second row 22. One first row 20 and one second row 22 may be disposed on the rotationally leading side of the junk slot 24. The other first row 20 and second row 22 may be disposed on the rotationally trailing side of the junk slot 24. On either or both of the other reaming blocks 14, only one first row 20 and one second row 22 of cutters may be disposed, each on opposed sides of the respective junk slot 24 as shown. The first rows 20 and second rows 22 may be arranged longitudinally so that the cutters 18, 16 in each row 20, 22 longitudinally alternate, as explained with reference to FIGS. 1 and 2. Such arrangement may provide increased diametric reaming coverage between the gage diameter of the drill bit (not shown) and the gage diameter of the reaming tool. As explained previously, it is only necessary to have a first row 20 and a second row 22 of gouging cutters on at least one reaming block 14; presence of absence of cutters and their arrangement on any of the other reaming blocks is a matter of discretion.

Figure 4:
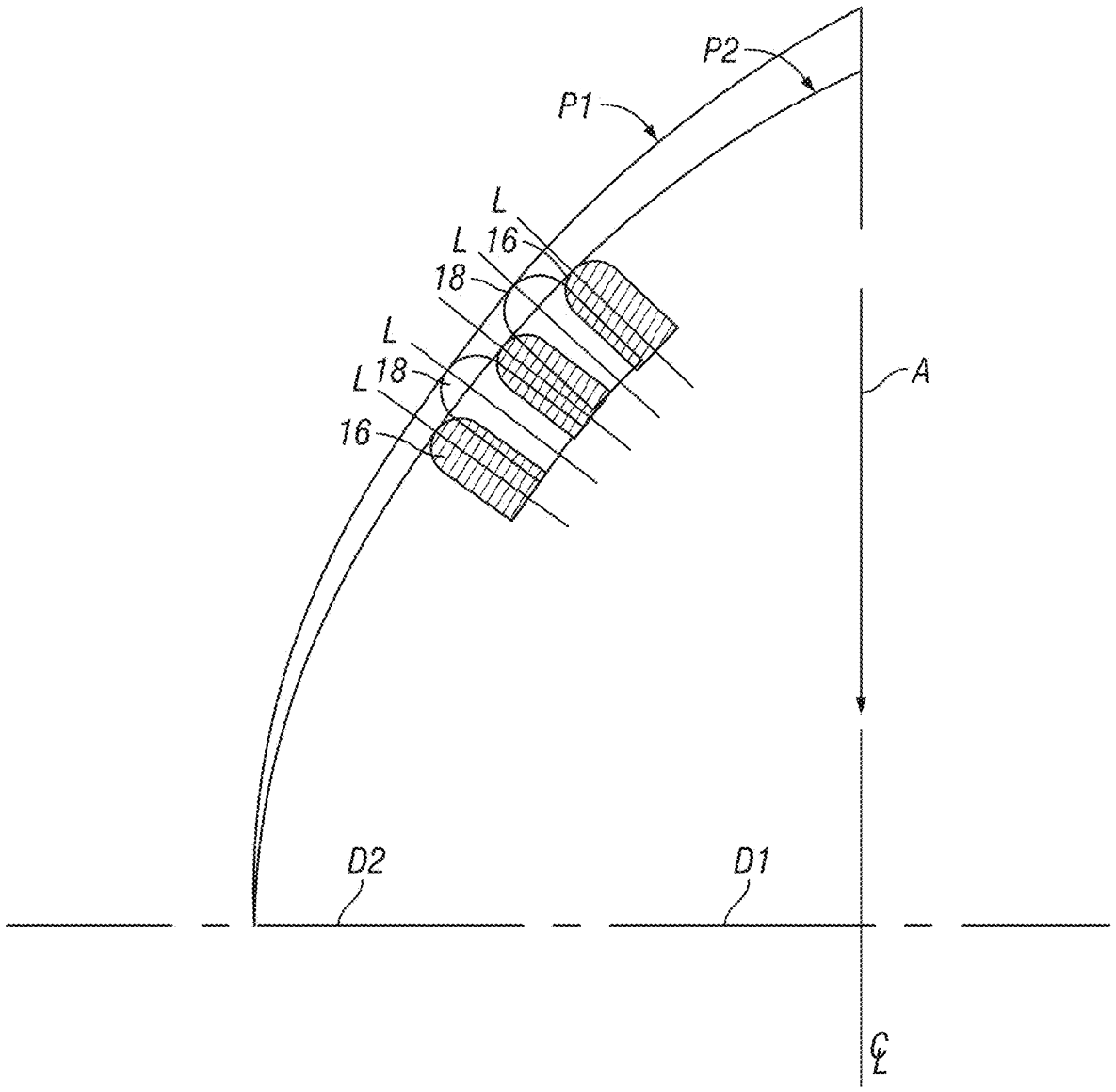
FIG. 4 shows a profile view, i.e., a cross-section rotated into a single plane, to illustrate arrangements of cutters in some embodiments.

FIG. 4 shows another possible arrangement of the gouging cutters that may be used in some embodiments. The view in FIG. 4 is known as a profile view, wherein a cross-section of the reaming tool is rotated into a single plane to better observe the cutting pattern defined by the gouging cutters 16, 18. The gouging cutters 18 in the first row or first rows (e.g., 20 in FIG. 1 or FIG. 3) may define a first profile P1. The gouging cutters 16 in the second or rows (e.g., 22 in FIG. 1 or FIG. 3) may define a second profile P2. The first and second profiles P1, P2 may each be understood as a curve that connects the outermost point on each cutter in each profile. In the example embodiment in FIG. 4, the first profile P1 may define a curve in which for any longitudinal position along the reaming block (14 in FIG. 2), a cutter located on the first profile P1 defines a larger cutting diameter than a cutter located in the same corresponding longitudinal position on the reaming block on the second profile P2. As may be understood with reference to FIG. 2 in particular, and along the direction of arrow A along the centerline CL in FIG. 4, cutters located at corresponding longitudinal positions, meaning a same distance from one longitudinal end of the reaming tool along each reaming block (14 in FIG. 2) define essentially the same (reaming) diameter at any circumferential position around any reaming block (14 in FIG. 1). In some embodiments, a diameter offset of the first profile P1 with reference to the second profile P2 may be constant. In some embodiments, and as shown in FIG. 4, a diameter offset of the first profile P1 with respect to the second profile P2 may vary with respect to distance from the center of rotation (C in FIG. 3) of the reaming tool. The example embodiment shown in FIG. 1 has a first offset X at diametric distance D1 that is larger than a second offset Y at diametric distance D2. The offset in the example embodiment of FIG. 4 decreases monotonically to zero at the gage diameter of the reaming tool. In other embodiments, a variable offset may change in any other way between largest and smallest offsets with respect to diameter.

A reaming tool according to the present disclosure may provide increase reaming performance and have increased longevity over reaming tools known in the art prior to the present disclosure.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A reaming tool, comprising:

a reaming tool body configured to be coupled within a drill string or a string of drilling tools;

a plurality of reaming blocks attached to the reaming tool body at circumferentially spaced apart locations; and wherein at least one reaming block comprises at least a first row of gouging cutters having non-planar cutting surfaces and a second row of gouging cutters having non planar cutting surfaces, the gouging cutters in the first row defining a first profile, the gouging cutters in the second row defining a second profile, wherein the first row is rotationally ahead of the second row, and wherein the first profile at any longitudinal position along the at least one reaming block defines a larger reaming diameter than the second profile at the same longitudinal position.

2. The reaming tool of claim 1 wherein the gouging cutters are mounted to the reaming block such that a longitudinal axis of the gouging cutters is at most 30 degrees from perpendicular to a face of the reaming block.

3. The reaming tool of claim 1 wherein the first profile extends more than the second profile by a variable offset.

4. The reaming tool of claim 3 wherein the variable offset decreases monotonically to zero at a gage diameter.

5. The reaming tool of claim 1 wherein the cutters in the second row are longitudinally displaced from the cutters in the first row so as to increase reaming coverage between a gage diameter of the reaming tool and a gage diameter of a drill bit disposed in a drill string ahead of the reaming tool.

6. The reaming tool of claim 1 wherein the second row is disposed on an opposed side of a junk slot in the at least one reaming block than the first row.

7. The reaming tool of claim 1 wherein the second row is disposed on a same side of a junk slot in the at least one reaming block than the first row.

8. The reaming tool of claim 7 further comprising a further first row of gouging cutters and a further second row of gouging cutters on an opposite side of the junk slot as the first row and the second row.

9. The reaming tool of claim 1 wherein the reaming blocks each defines a tapered profile in a longitudinal direction along the reaming tool.

10. The reaming tool of claim 1 wherein each of the plurality of reaming blocks comprises at least a first row of gouging cutters, and a second row of gouging cutters, the gouging cutters in the first row defining a first profile, the gouging cutters in the second row defining a second profile, wherein the first row is rotationally ahead of the second row, and wherein the first profile at any longitudinal position along the at least one reaming block defines a larger reaming diameter than the second profile.

11. The reaming tool of claim 10 wherein the gouging cutters in each of the plurality of reaming blocks are mounted to each reaming block such that a longitudinal axis of the gouging cutters is at most 30 degrees from perpendicular to a face of the reaming block.

12. The reaming tool of claim 10 wherein the first profile extends more than the second profile by a variable offset.

13. The reaming tool of claim 12 wherein the variable offset decreases monotonically to zero at a gage diameter.

14. The reaming tool of claim 10 wherein the cutters in the second row are longitudinally displaced from the cutters in the first row so as to increase reaming coverage between a gage diameter of the reaming tool and a gage diameter of a drill bit disposed in a drill string ahead of the reaming tool.

15. The reaming tool of claim 10 wherein the second row is disposed on an opposed side of a junk slot in the at least one reaming block than the first row.

16. The reaming tool of claim 10 wherein the second row is disposed on a same side of a junk slot in the at least one reaming block than the first row.

17. The reaming tool of claim 16 further comprising a further first row of gouging cutters and a further second row of gouging cutters on an opposite side of the junk slot as the first row and the second row.

18. The reaming tool of claim 10 wherein the reaming blocks each defines a tapered profile in a longitudinal direction along the reaming tool.

* * * * *